US006345434B1

(12) United States Patent
Anbo et al.

(10) Patent No.: US 6,345,434 B1
(45) Date of Patent: Feb. 12, 2002

(54) PROCESS OF MANUFACTURING AN INDUCTOR DEVICE WITH STACKED COIL PATTERN UNITS

(75) Inventors: Toshiyuki Anbo; Fumio Uchikoba, both of Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/346,697

(22) Filed: Jul. 2, 1999

(30) Foreign Application Priority Data

Jul. 6, 1998 (JP) ..... 10-189554

(51) Int. Cl.[7] ..... H01F 7/06

(52) U.S. Cl. ..... 29/602.1; 29/609; 29/606; 29/604; 336/200; 336/223

(58) Field of Search ..... 29/602.1, 606, 29/604, 609; 336/200, 232, 223; 174/262

(56) References Cited

U.S. PATENT DOCUMENTS

| | | | | | |
|---|---|---|---|---|---|
| 3,765,082 | A | * | 10/1973 | Zyetz | 29/602 |
| 4,543,553 | A | * | 9/1985 | Mandai et al. | 336/83 |
| 4,792,790 | A | * | 12/1988 | Reeb | 340/572 |
| 5,032,815 | A | * | 7/1991 | Kobayashi et al. | 336/83 |
| 5,515,022 | A | * | 5/1996 | Tashiro et al. | 336/200 |
| 5,970,604 | A | * | 10/1999 | Person et al. | 29/609 |
| 6,124,779 | A | * | 9/2000 | Yamamoto | 336/200 |
| 6,147,573 | A | * | 11/2000 | Kumagai et al. | 333/185 |

FOREIGN PATENT DOCUMENTS

| | | | | |
|---|---|---|---|---|
| FR | 2 379 229 | | 8/1978 | |
| JP | 05055066 | * | 3/1993 | 29/602.1 |
| JP | 05055067 | * | 3/1993 | 29/602.1 |
| JP | A-6-20843 | | 1/1994 | |
| JP | 06053050 | * | 2/1994 | 29/602.1 |
| JP | A-6-77074 | | 3/1994 | |
| JP | 06069040 | * | 3/1994 | 29/602.1 |
| JP | A-7-192954 | | 7/1995 | |
| JP | A-7-192955 | | 7/1995 | |
| JP | 9-148139 | | 6/1997 | |

* cited by examiner

*Primary Examiner*—Lee Young
*Assistant Examiner*—Minh Trinh
(74) *Attorney, Agent, or Firm*—Oliff & Berridge

(57) ABSTRACT

A process for the production of an inductor device comprising the steps of forming a green sheet to form an insulating layer; forming a plurality of conductive coil pattern units on the surface of the green sheet in order that a plurality of unit sections each including a single coil pattern unit are arranged on the surface of the green sheet and each two coil pattern units adjoining in the substantially perpendicular direction to the longitudinal direction of the unit sections are arranged centro-symmetrically with respect to a center point of a boundary line of adjoining unit sections; stacking a plurality of green sheets formed with the plurality of coil pattern units arranged in centro-symmetry and connecting the upper and lower coil pattern units separated by the green sheets to form a coil shape; and sintering the stacked green sheets. It is possible to obtain an inductor device able to suppress the stack deviation without complicating the production process even if the device is made small in size.

8 Claims, 11 Drawing Sheets

PROCESS OF MANUFACTURING AN INDUCTOR DEVICE WITH STACKED COIL PATTERN UNITS

BACKGROUND OF THE INVENTION

1. Field of the Invention

The present invention relates to an inductor device and a process of production thereof.

2. Description of the Related Art

The market is constantly demanding that electronic equipment be made smaller in size. Greater compactness is therefore required in the devices used in electronic equipment as well. Electronic devices originally having lead wires have evolved into so-called "chip devices" without lead wires along with the advances made in surface mounting technology. Capacitors, inductors, and other devices comprised mainly of ceramics are produced using the sheet process based on thick film forming techniques or using screen printing techniques etc. and using cofiring process of the ceramics and metal. This enables realization of a monolithic structure provided with internal conductors and a further reduction of size.

The following process of production has been adopted to produce such a chip-shaped inductor device.

First, a ceramic powder is mixed with a solution containing a binder or organic solvent etc. This mixture is cast on a polyethylene terephthalate (PET) film using a doctor blade method etc. to obtain a green sheet of several tens of microns or several hundreds of microns in thickness. Next, this green sheet is machined or processed by laser etc. to form through holes for connecting coil pattern units of different layers. The thus obtained green sheet is coated with a silver or a silver-palladium conductor paste by screen printing to form conductive coil pattern units corresponding to the internal conductors. At this stage, the through holes are also filled with the paste for the electrical connection between layers.

A predetermined number of these green sheets are then stacked and press-bonded at a suitable temperature and pressure, then cut into portions corresponding to individual chips which are then processed to remove the binder and sintered. The sintered chips are barrel polished, then coated with silver paste for forming the terminations and then again heat treated. These are then electrolytically plated to form a tin or other coating. As a result of the above steps, a coil structure is realized inside of the insulator comprised of ceramics and thereby an inductor device is fabricated.

There have been even further demands for miniaturization of such inductor devices. The main chip sizes have shifted from the 3216 (3.2×1.6×0.9 mm) shape to 2012 (2.0×1.2×0.9 mm), 1608 (1.6×0.8×0.8 mm), and even further smaller shapes. Recently, chip sizes of 1005 (1×0.5×0.5 mm) have been realized. This trend toward miniaturization has gradually made the requirements for dimensional accuracy (clearance) on the steps severer in order to obtain stable and high quality.

For example, in an inductor device of a chip size of 1005, the stack deviation of the internal conductor layers is not allowed to exceed more than 30 $\mu$m. If this is exceeded, remarkable variations occur in the inductance or impedance. In extreme cases, the internal conductors are even exposed. An inductor array device of a chip size of 2010(2.0×1.0×0.5 mm) having four coils within the single device has the same problems as described above.

In the case of an inductor device of a relatively large chip size of the related art, this stack deviation was not serious enough to have a notable effect on the properties of the device, but with a chip size of about 1005 or 2010, stack deviations have a tremendous effect on the device properties.

In the inductor devices of a relatively large size of the related art, the coil pattern units of the internal conductors in the different layers were L-shaped or reverse L-shaped. The L-shaped pattern units and reverse L-shaped pattern units were alternately stacked and through holes were provided at the ends of these patterns to connect the patterns of the different layers. The starting ends and finishing ends of the coil formed in this way were connected to leadout patterns.

Experiments by the present inventors etc. have shown, however, that when making the coil pattern units of the internal conductors at different layers L-shaped and reverse L-shaped and simply making the coil pattern units smaller in order to obtain a 1005, 2010, or other small-sized inductor device, the stack deviation of the internal conductors remarkably progresses.

The reason why the stack deviation progresses in a small-sized inductor device is believed to be as follows: That is, to obtain a predetermined inductance or impedance despite reduction of the chip size, it is necessary to increase the number of turns of the coil. Therefore, it is necessary to make each of the ceramic layers thinner. Further, a low resistance is required in the internal conductors, so it is not allowed to make the conductors thinner by the same rate as the ceramic sheet. Therefore, a smaller chip size results in a remarkable non-flatness of a green sheet after printing.

As a result, when applying pressure to superposed green sheets to form them into a stack, the conductor portions, which are relatively hard compared with the green sheets themselves, interfere with each other and therefore cause remarkable stack deviation. In particular, in a printing pattern based on the L-shapes of the related art, the stacked green sheets were pushed at a slant 3-dimensionally through the internal conductors—which only aggravated the stack deviation. This phenomenon became a major hurdle to be overcome for stabilization of the quality of the device along with the increased reduction of the chip size of the devices.

Various proposals have been made to solve this problem. For example, Japanese Unexamined Patent Publication (Kokai) No. 6-77074 discloses to press printed green sheets in advance in order to flatten them. Further, Japanese Unexamined Patent Publication (Kokai) No. 7-192954 discloses to give the ceramic sheets grooves identical with the conductor patterns in advance, print the conductor paste in the grooves, and thereby obtain a flat ceramic sheet containing conductors. Further, Japanese Unexamined Patent Publication (Kokai) No. 7-192955 discloses not to peel off the PET film from the ceramic sheet, but to repeatedly stack another ceramic sheet, press it, then peel off the film. This method uses the fact that PET film undergoes little deformation and as a result could be considered a means for preventing stack deviation. Further, Japanese Unexamined Patent Publication (Kokai) No. 6-20843 discloses to provide a plurality of through holes along the circumference of the printed conductors so as to disperse the pressure at the time of press-bonding.

Each of the methods disclosed in the above publications added further steps to the method of stacking the ceramic sheets of the related art or made major changes in it. Further, they were more complicated than the method of the related art and therefore disadvantageous from the viewpoint of productivity.

SUMMARY OF THE INVENTION

An object of the present invention is to provide a process for the production of an inductor device able to suppress stack deviation without complicating the production process—even if the device is made smaller—and an inductor device made by that process.

The present inventors engaged in intensive studies of a process for production of a small-sized inductor device able to suppress stack deviation without complicating the production process and an inductor device produced by the same and as a result discovered that it is possible to suppress the stack deviation by suitably determining the repeating pattern shape of coil pattern units formed between insulator layers of the device and thereby completed the present invention.

According to the present invention, there is provided a process for the production of an inductor device comprising the steps of: forming a green sheet to form an insulating layer; forming a plurality of conductive coil pattern units on the surface of the green sheet so that a plurality of unit sections each including a single coil pattern unit are arranged on the surface of the green sheet and each two coil pattern units adjoining in the substantially perpendicular direction to the longitudinal direction of the unit sections are arranged centro-symmetrically with respect to a center point of a boundary line of adjoining unit sections; stacking a plurality of green sheets formed with the plurality of coil pattern units arranged centro-symmetrically and connecting the upper and lower coil pattern units separated by the green sheets to form a coil shape; and sintering the stacked green sheets.

In order to produce large numbers of inductor devices on an industrial scale, generally a plurality of coil pattern units are formed on the surface of a green sheet by screen printing etc. In the related art, these coil pattern units were all formed in the same orientation and same shape in every unit section of a single green sheet. Coil pattern units have to be able to be connected in the stacking direction in order to form coils and further have to such as to enable the cross sectional area of the coil to be made as large as possible within the limited area of the unit section, so normally have linear patterns extending along the longitudinal direction of the unit sections. The linear patterns in the coil pattern units extend along the longitudinal direction of the unit sections and are superposed in the stacking direction through green sheets, so the stacked green sheets tend to easily shift in a direction substantially perpendicular to the longitudinal direction of the linear patterns (longitudinal direction of unit sections). This tendency becomes more remmarkable as the device is made smaller, that is, as the area of the unit sections is made smaller.

In the process of production of an inductor device according to the present invention, each two coil pattern units adjoining in a direction substantially perpendicular to the longitudinal direction of the unit sections are arranged centro-symmetrically with respect to a center point of a boundary line of adjoining unit sections. Therefore, even if linear patterns of coil pattern units formed in the individual unit sections start to shift in the direction perpendicular to the linear patterns due to being superposed in the stacking direction, the linear patterns of the coil pattern units positioned below the adjoining unit sections will interfere with the shifting. As a result, in the present invention, it is possible to effectively prevent stack deviation particularly in a direction substantially perpendicular to the longitudinal direction of the unit sections (longitudinal direction of linear patterns). Note that the stack deviation in the longitudinal direction of the unit sections is inherently small and does not become a problem.

In the process of production according to the present invention, when forming the plurality of coil pattern units on the surface of the green sheet, preferably each two coil pattern units adjoining in the longitudinal direction of the unit sections are arranged at the same positions inside the individual unit sections. Alternatively, each two coil pattern units adjoining in the longitudinal direction of the unit sections may be arranged centro-symmetrically with respect to a center point of a boundary line of adjoining unit sections.

In the process of production according to the present invention, preferably the coil pattern units are each comprised of two substantially parallel linear patterns and a curved pattern connecting first ends of the linear patterns. Further, the coil pattern units are each comprised of line symmetric patterns about a center line dividing a unit section across its width direction. By making such coil pattern units, it is possible to further reduce the stack deviation while obtaining the desired inductor characteristics.

Further, preferably the plurality of green sheets are stacked so that each two coil pattern units adjoining each other in the stacking direction through a green sheet become line symmetrical with respect to a center line dividing the unit sections across the longitudinal direction. By stacking the green sheets in accordance with this positional relationship, it is possible to further reduce the stack deviation.

Further, preferably coil pattern units of a thickness of ⅓ to ½ of the thickness of the green sheets are formed on the surface of green sheets of a thickness of 3 to 25 $\mu$m. When stacking relatively thin green sheets in this way, stack deviation easily occurs, but in the present invention it is possible to reduce the stack deviation even in such a case. Note that when the thickness of the coil pattern units exceeds ⅔ of the thickness of the green sheets, there is a tendency for suppression of the stack deviation to become difficult even in the present invention. When the thickness of the coil pattern units is smaller than ⅓ the thickness of the green sheets, there is little chance of the stack deviation becoming a problem, but the electrical resistance of the coil pattern units becomes large—which is not desirable for an inductor device.

Further, the process of production according to the present invention may include, before the sintering step, a step of cutting the stacked green sheets for each unit section or may include a step of cutting the stacked green sheets for each plurality of unit sections. By cutting the stacked green sheets for each unit section, it is possible to obtain an inductor device having a single coil inside the device. Further, by cutting the stacked green sheets for each plurality of unit sections, it is possible to obtain an inductor device having a plurality of coils inside the device (also called an "inductor array device").

According to the present invention, there is provided an inductor device comprising a device body having a plurality of insulating layers; a plurality of conductive coil pattern units formed inside the device body between insulating layers along a single planar direction, coil pattern units adjoining each other in the single plane being centro-symmetric patterns with respect to a center point of a boundary line between unit sections containing coil pattern units; and connection portions connecting upper and lower coil pattern units separated by the insulating layers to form a coil.

According to the present invention, it is possible to produce an inductor device by the above process of production of the present invention and possible to suppress stack deviation without complicating the production process even if the device is made small in size.

BRIEF DESCRIPTION OF THE DRAWINGS

These and other objects and features of the present invention will become clearer from the following description of the preferred embodiments given with reference to the attached drawings, in which.

DESCRIPTION OF THE PREFERRED EMBODIMENTS

First Embodiment

Figure 1:
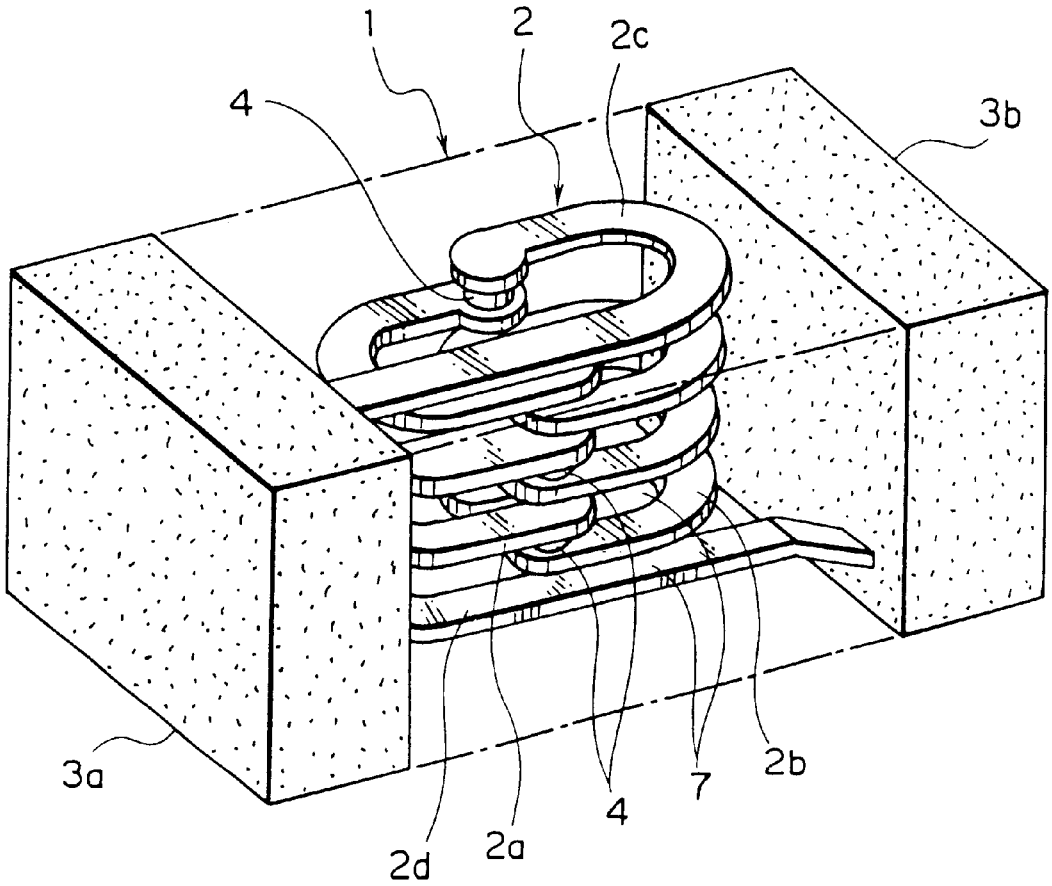
FIG. 1 is a partial transparent perspective view of an inductor device according to an embodiment of the present invention.

As shown in FIG. 1, the inductor device according to the first embodiment has a device body 1. The device body 1 has terminations 3*a* and 3*b* formed integrally at its two ends. The device body 1 further has alternately stacked inside it coil pattern units 2*a* and 2*b* which lie between insulating layers 7. In the present embodiment, the end of the coil pattern unit 2*c* stacked at the top is connected to one termination 3*a*, while the end of the coil pattern unit 2*d* stacked at the bottom is connected to the other termination 3*b*. These coil pattern units 2*a*, 2*b*, 2*c*, and 2*d* are connected through through holes 4 formed in the insulating layers 7 and together constitute a coil 2.

The insulating layers 7 constituting the device body 1 are for example comprised of ferrite, a ferrite-glass composite, or other magnetic material or an alumina-glass composite, crystallized glass, or other dielectric material, etc. The coil pattern units 2*a*, 2*b*, 2*c*, and 2*d* are for example comprised of silver, palladium, alloys of the same, or other metals. The terminations 3*a* and 3*b* are sintered members comprised mainly of silver and are plated on their surfaces with copper, nickel, tin, tin-lead alloys, or other metals. The terminations 3*a* and 3*b* may be comprised of single layers or multiple layers of these metals.

Next, an explanation will be given of a process for production of the inductor device shown in FIG. 1.

Figure 2A:
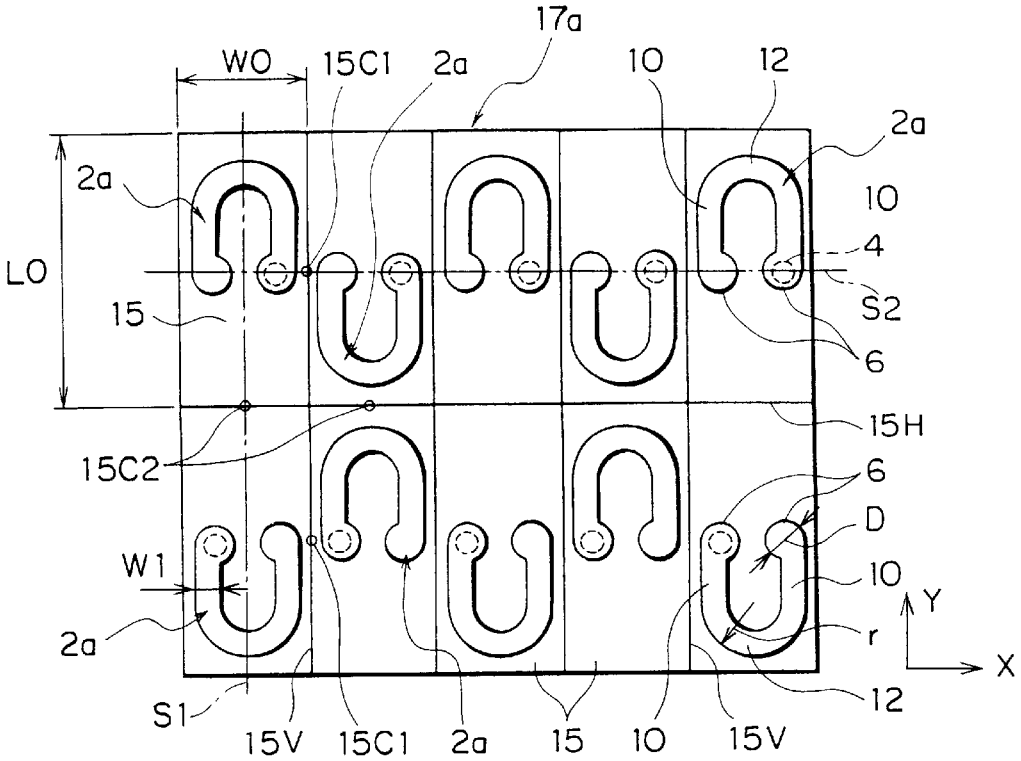
FIG. 2A and FIG. 2B are plane views of coil pattern units formed on green sheets.
Figure 2B:
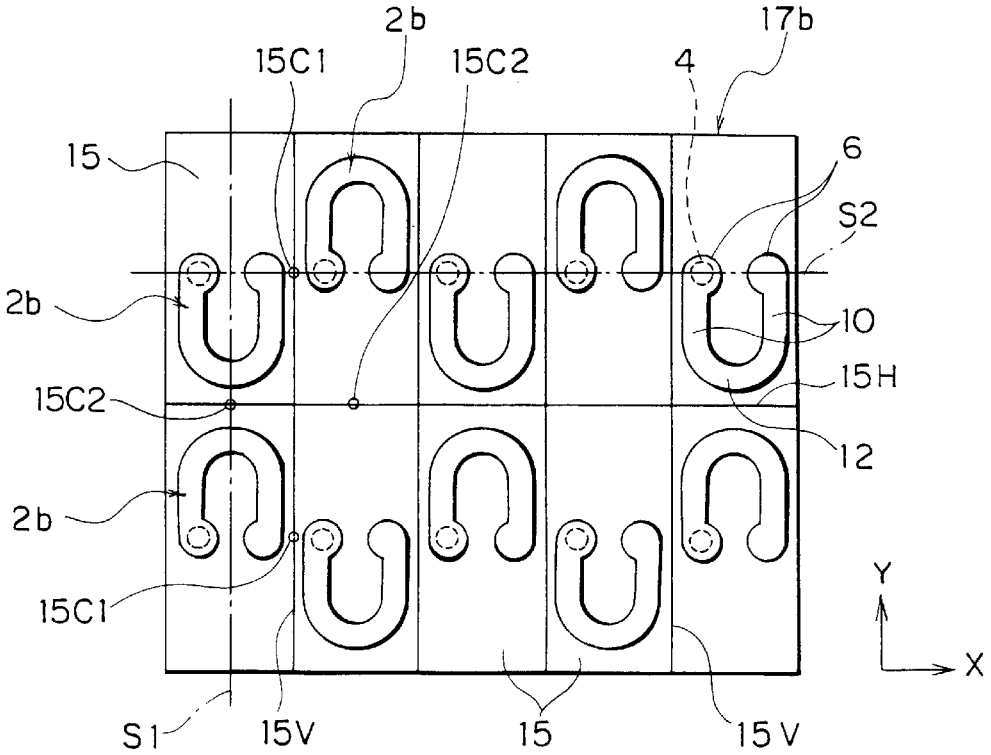

As shown in FIG. 2A and FIG. 2B, first, green sheets 17*a* and 17*b* are prepared for forming the insulating layers 7. The green sheets 17*a* and 17*b* are obtained by mixing a ceramic powder with a solution containing a binder or organic solvent etc. to form a slurry, coating the slurry on a PET film or other base film by the doctor blade method etc., drying it, then peeling off the base film. The thickness of the green sheets is not particularly limited, but is several tens of microns to several hundreds of microns.

The ceramic powder is not particularly limited, but for example is a ferrite powder, ferrite-glass composite, glass-alumina composite, crystallized glass, etc. The binder is not particularly limited, but may be a butyral resin, acrylic resin, etc. As the organic solvent, toluene, xylene, isobutyl alcohol, ethanol, etc. may be used.

Next, these green sheets 17*a* and 17*b* are machined or processed by laser etc. to form a predetermined pattern of through holes 4 for connecting coil pattern units 2*a* and 2*b* of different layers. The thus obtained green sheets 17*a* and 17*b* are coated with a silver or silver-palladium conductor paste by screen printing to form a plurality of conductive coil pattern units 2*a* and 2*b* in a matrix array. At this time, the through holes 4 are also filled with paste. The coating thickness of the coil binder units 2*a* and 2*b* is not particularly limited, but normally is about 5 to 40 $\mu$m.

Each of the coil pattern units 2*a* and 2*b* has a substantially U-shape as a whole seen from the plane view and is provided with two substantially parallel linear patterns 10, a curved pattern 12 connecting first ends of these linear patterns 10, and connection portions 6 formed at second ends of the linear patterns 10. A through hole 4 is formed at one of the pair of connection portions 6.

The coil pattern units 2*a* and 2*b* are each formed in unit sections 15 dividing the green sheets 17*a* and 17*b* into grids. In this embodiment, the longitudinal direction Y of each unit section 15 matches with the longitudinal direction of the linear patterns 10 of the coil pattern units 2*a* and 2*b*.

The coil pattern units 2*a* and 2*b* are line-symmetric patterns with respect to a center line S1 dividing the unit section 15 across the width direction X. Further, as shown in FIG. 2A and 2B, each one coil pattern unit 2*a* (or 2*b*) and the coil pattern unit 2*b* (or 2*a*) positioned below or above the coil pattern unit 2*a* (or 2*b*) through a green sheet 17*a* are arranged at line-symmetric positions with respect to a center line S2 dividing the unit section 15 across the longitudinal direction.

The connection portions 6 of the coil pattern units 2*a* and 2*b* are substantially circular as seen from the plane view.

When taking note of the coil pattern unit 2*a*, one connection portion 6 is connected through a through hole 4 to one connection portion of the coil pattern unit 2*b* positioned directly underneath it, while the other connection portion 6 of the coil pattern unit 2*a* is connected through a not shown through hole to one connection portion of the coil pattern unit 2*b* positioned directly above it. By connecting the coil pattern units 2*a* and 2*b* through the connection portions 6 and through holes 4 in a spiral fashion in this way, a small sized coil 2 is formed inside the device body 1 as shown in FIG. 1.

As shown in FIG. 2A and FIG. 2B, in the present embodiment, each two coil pattern units 2*a* and 2*a* (or 2*b* and 2*b*) adjoining each other in the direction X substantially perpendicular to the longitudinal direction Y of the unit sections 15 are arranged centro-symmetrically with respect to a center point 15C1 of a vertical boundary line 15V of adjoining unit sections 15. Further, each two coil pattern units 2*a* and 2*a* (or 2*b* and 2*b*) adjoining each other in the longitudinal direction Y of the unit sections 15 are arranged centro-symmetrically with respect to a center point 15C2 of a horizontal boundary line 15H of adjoining unit sections 15.

Next, a predetermined number of these green sheets 17*a* and 17*b* are alternately superposed, then are press-bonded at a suitable temperature and pressure. Note that in actuality, in addition to the green sheets 17*a* and 17*b*, green sheets formed with the coil pattern units 2*c* or 2*d* shown in FIG. 1 are also stacked together with the green sheets 17*a* and 17*b*. Further, green sheets not formed with each coil pattern units may also be additionally stacked and press-bonded in accordance with need.

Figure 3A:
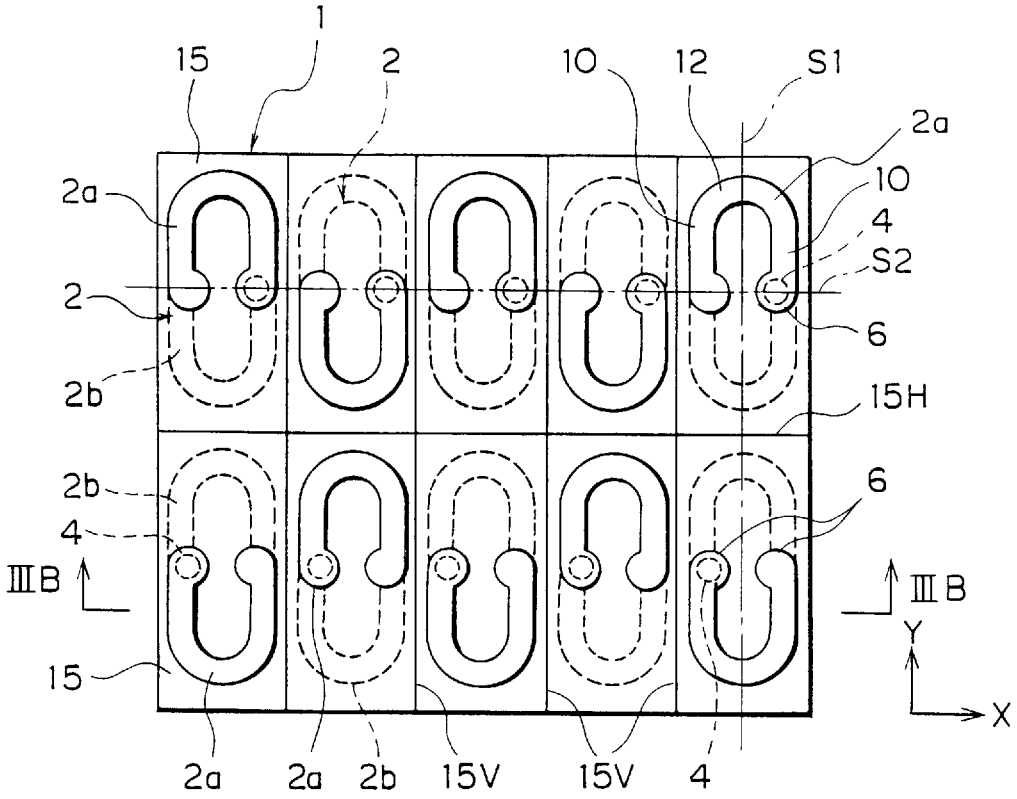
FIG. 3A is a plane view of an arrangement of coil pattern units after stacking the green sheets shown in FIG. 2A and FIG. 2B.
Figure 3B:
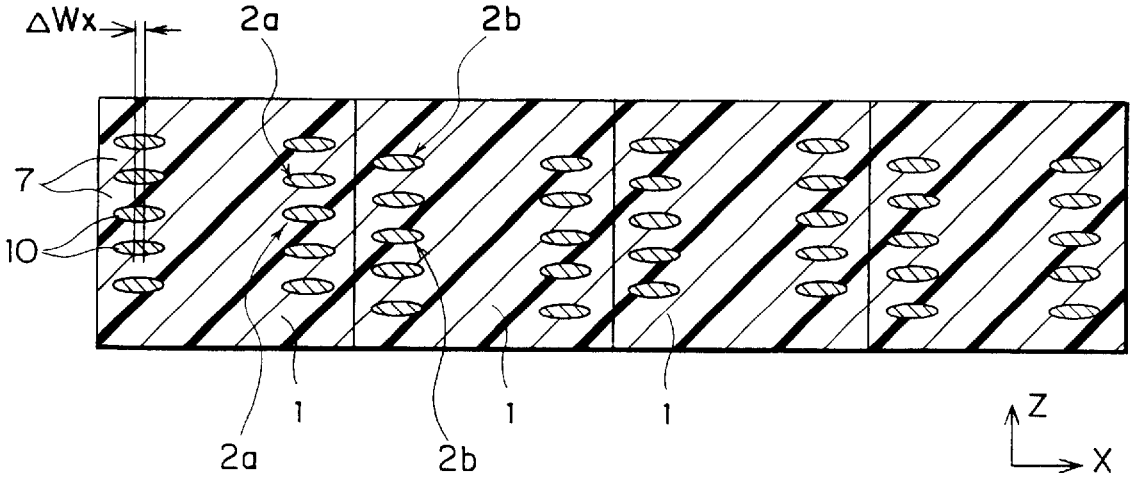
FIG. 3B is a sectional view of key parts along the line IIIB—IIIB of FIG. 3A.

In this embodiment, the shapes and arrangements of the coil pattern units 2*a* and 2*b* formed at the surfaces of the green sheets 17*a* and 17*b* are set to the above-mentioned conditions. Therefore, as shown in FIG. 3B, when press-bonding the green sheets 17*a* and 17*b*, the stack deviation ΔWx along the direction X perpendicular to the longitudinal direction of the unit sections 15 can be made much smaller than in the related art. This is believed to be due to the following reason.

Figure 3C:
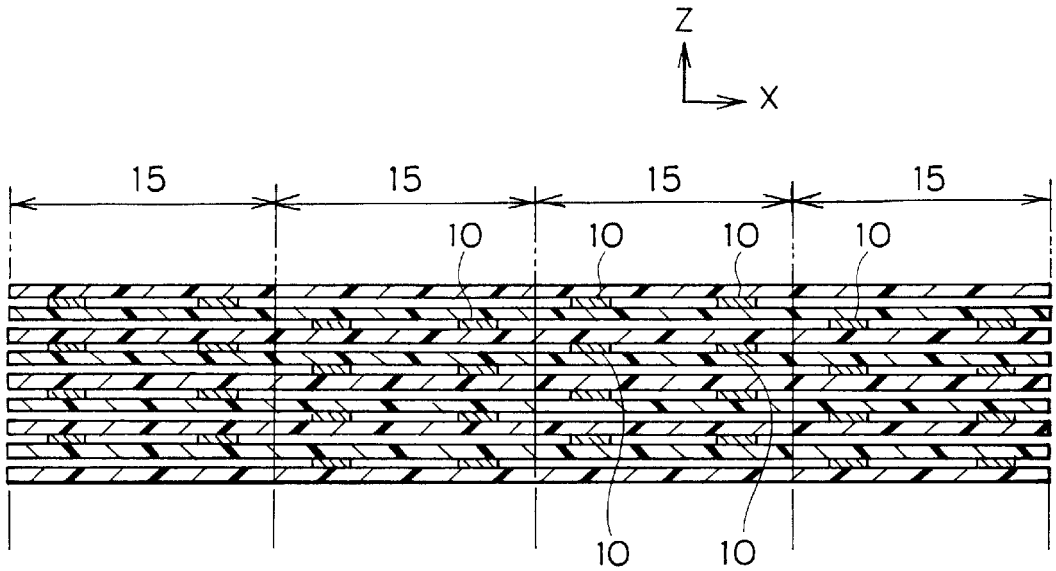
FIG. 3C and FIG. 3D are sectional views of key parts for explaining stack deviation.

That is, in the present embodiment, as shown in FIG. 2A and FIG. 2B, each two coil pattern units 2*a* and 2*a* (or 2*b* and 2*b*) adjoining each other in the direction X substantially perpendicular to the longitudinal direction Y of the unit sections 15 are arranged centro-symmetrically with respect to a center point 15C1 of a vertical boundary line 15V of adjoining unit sections 15. Therefore, as shown in FIG. 3C, due to the superposition, in the stacking direction Z, of the linear patterns 10 of the coil pattern units formed in the unit sections, even if shifting of the linear patterns 10 starts in the perpendicular direction X, the linear patterns 10 of coil pattern units positioned under adjoining unit sections 15 will interfere with the shifting. As a result, in the present embodiment, it is possible to effectively prevent stack deviation in the direction X substantially perpendicular to the longitudinal direction Y of the unit sections 15 (longitudinal direction of the linear patterns 10).

Figure 10A:
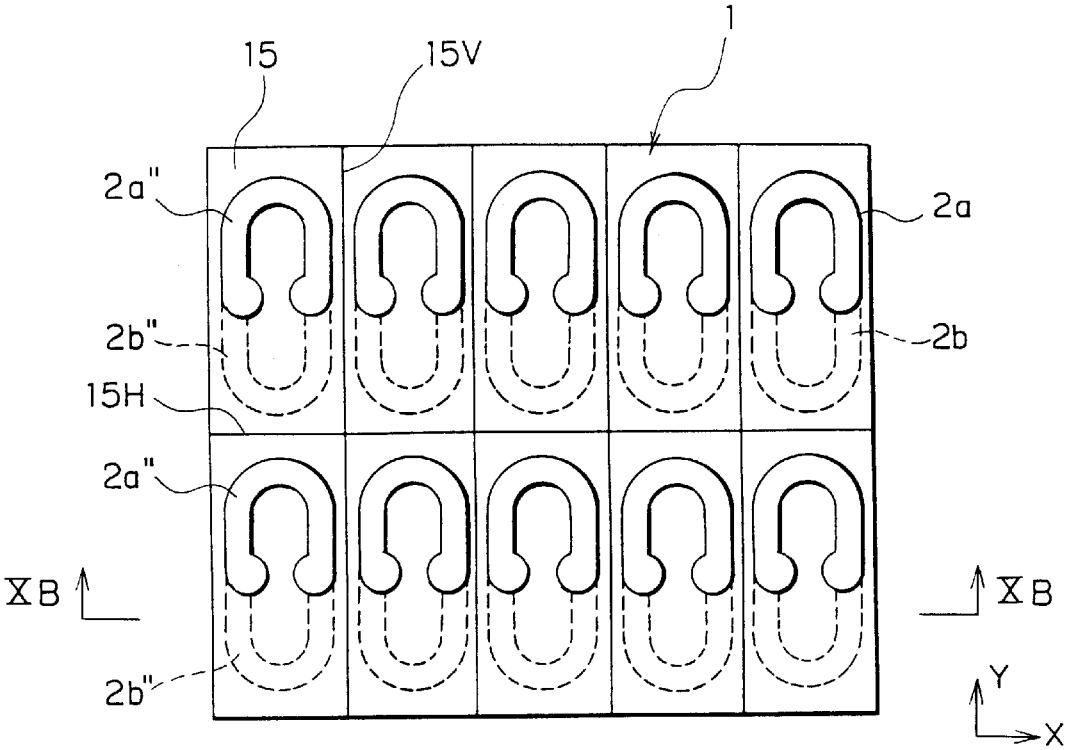
FIG. 10A is a plane view of an arrangement of coil pattern units after stacking the green sheets shown in FIG. 9A and FIG. 9B.
Figure 10B:
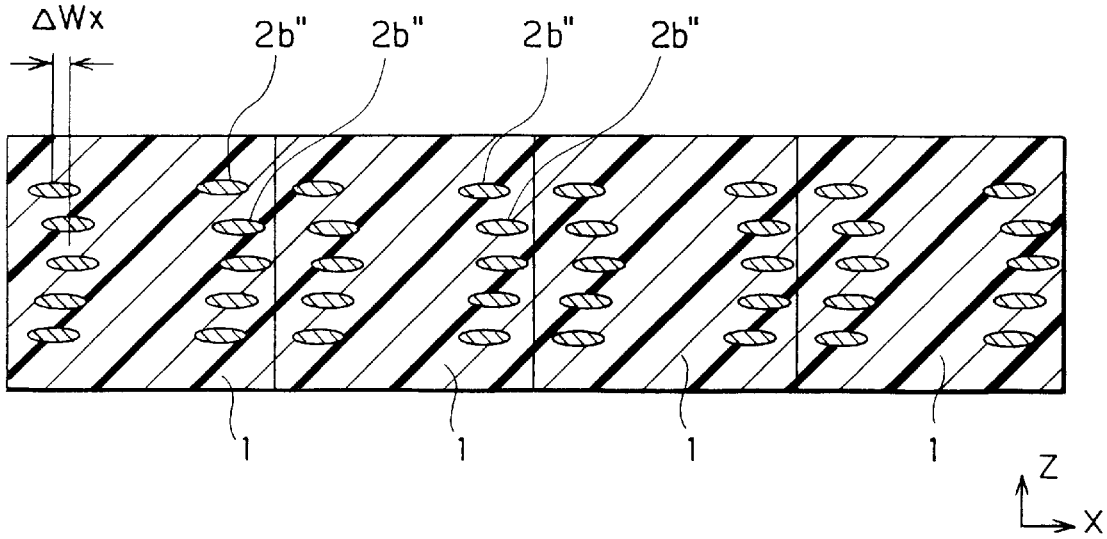
FIG. 10B is a sectional view of key parts along the line XB—XB of FIG. 10A.

As opposed to this, as shown for example in FIG. 10A, when each two coil pattern units 2*a*" and 2*a*" ( 2*b*" and 2*b*") adjoining each other in the direction X are arranged line symmetrically with respect to the vertical boundary line 15V of adjoining unit sections 15, stack deviation easily occurs due to the following reason.

Figure 3D:
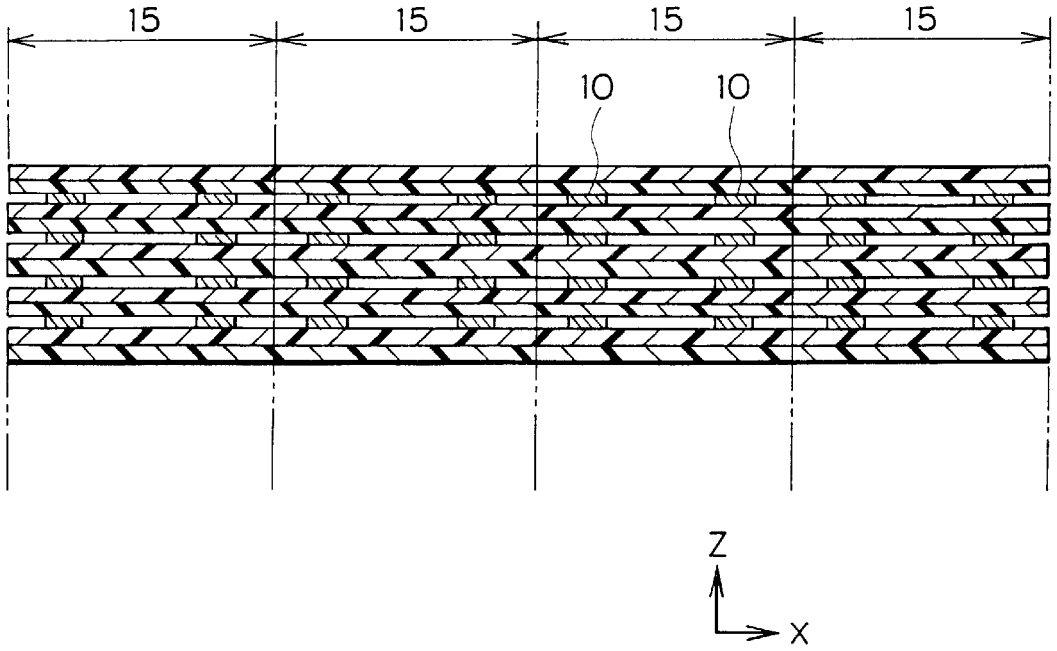

That is, in the case of FIG. 10A, as shown in FIG. 3D, due to the superposition, in the stacking direction Z, of the linear patterns 10 of the coil pattern units formed in the unit sections 15, shifting of the linear patterns 10 in the vertical direction X starts to occur. In the case of FIG. 3D, unlike the case of FIG. 3C, even if the linear patterns 10 start to shift in the X direction, there are no patterns interfering with this shift.

In the present embodiment, since, as shown in FIG. 3C, the linear patterns 10 are arranged offset from each other in the stacking direction Z, it is possible to effectively prevent stack deviation in the direction X substantially perpendicular to the longitudinal direction Y of the linear patterns 10. Note that the stack deviation ΔWy (not shown) in the longitudinal direction Y of the linear patterns 10 is inherently small and does not become a problem.

In the present embodiment, after the green sheets 17*a* and 17*b* are stacked, they are cut along the boundary lines 15H and 15V of the unit sections 15 into portions corresponding to individual device bodies 1. In the present embodiment, the stacked green sheets are cut so that one pattern unit 2*a* or 2*b* is contained in each unit section 15 of the green sheets 17*a* or 17*b* so as to obtain green chips corresponding to the device bodies 1.

Next, each green chip is treated to remove the binder and sintered or otherwise heat treated. The ambient temperature at the time of treatment to remove the binder is not particularly limited, but may be from 150° C. to 250° C. Further, the sintering temperature is not particularly limited, but may be from 850° C. to 960° C. or so.

Next, the two ends of the obtained sintered chip are barrel polished, then coated with silver paste for forming the terminations 3*a* and 3*b* shown in FIG. 1. The chip is then again heat treated, then is electrolytically plated with tin or a tin-lead alloy or the like to obtain the terminations 3*a* and 3*b*. As a result of the above steps, a coil 2 is realized inside the device body 1 formed of ceramic and an inductor device is fabricated.

Note that in the present invention, the stack deviation ΔWx in the X-direction, as shown in FIG. 3B, means the X-direction deviation of the center position between linear patterns 10 in a coil pattern 2*a* (or 2*b*) stacked in the stacking direction (vertical direction) Z sandwiching insulating layers 7. Further, the stack deviation ΔWy in the Y-direction, while not shown, means the Y-direction deviation of the center position between connection portions 6 in a coil pattern 2*a* (or 2*b*) stacked in the stacking direction (vertical direction) Z sandwiching insulating layers.

Second Embodiment

Figure 4A:
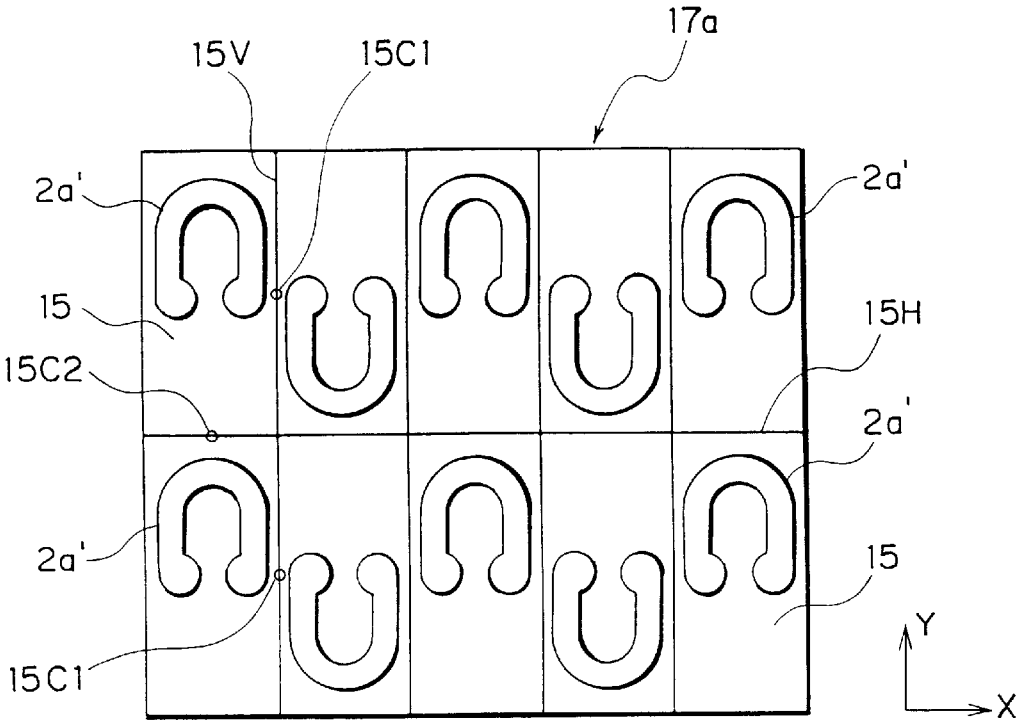
FIG. 4A and FIG. 4B are plane views of arrangements of coil pattern units according to another embodiment of the present invention.
Figure 4B:
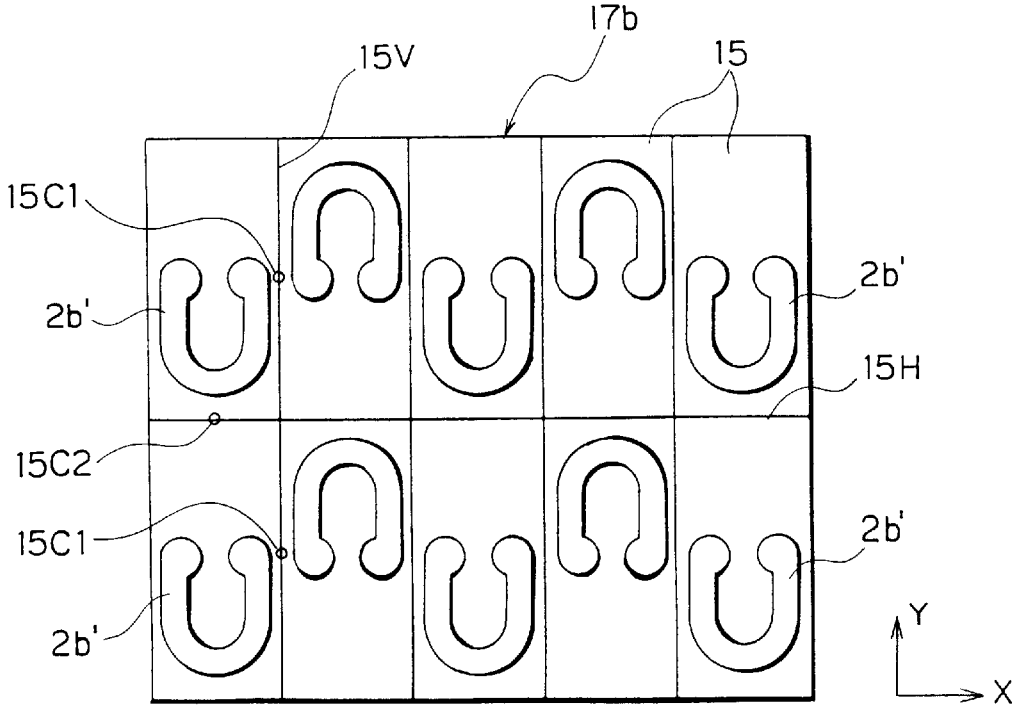

As shown in FIG. 4A and FIG. 4BA, in the process of production of an inductor device according to the second embodiment, the pattern shapes themselves of the coil pattern units 2*a*' and 2*b*' formed inside the unit sections 15 of the green sheets 17*a* and 17*b* are the same as the pattern shapes of the coil pattern units 2*a* and 2*b* according to the first embodiment, but the arrangements of the patterns differ. That is, in the present invention, as shown in FIG. 4A and FIG. 4B, each two coil pattern units 2*a*' and 2*a*' (or 2*b*' and 2*b*') adjoining each other in the longitudinal direction Y of the unit sections 15 are arranged in patterns not centro-symmetric with respect to a center point 15C2 of the horizontal boundary line 15H of adjoining unit sections 15. That is, in the present embodiment, each two coil pattern units 2*a*' and 2*a*' (or 2*b*' and 2*b*') adjoining each other in the longitudinal direction Y of the unit sections 15 are arranged at the same positions in the unit sections 15.

Note that this embodiment is similar to the first embodiment in the point that each two coil pattern units 2*a*' and 2*a*' (or 2*b*' and 2*b*') adjoining each other in the direction X substantially perpendicular to the longitudinal direction Y of the unit sections 15 are arranged centro-symmetrically with respect to a center point 15C1 of the vertical boundary line 15V of the adjoining unit sections 15.

In the process of production of an inductor device according to the present embodiment, only the pattern of arrangement of the coil pattern units 2*a*' and 2*b*' on the green sheets 17*a* and 17*b* differ from the case of the first embodiment. The rest of the steps are the same as the case of the first embodiment.

Figure 5A:
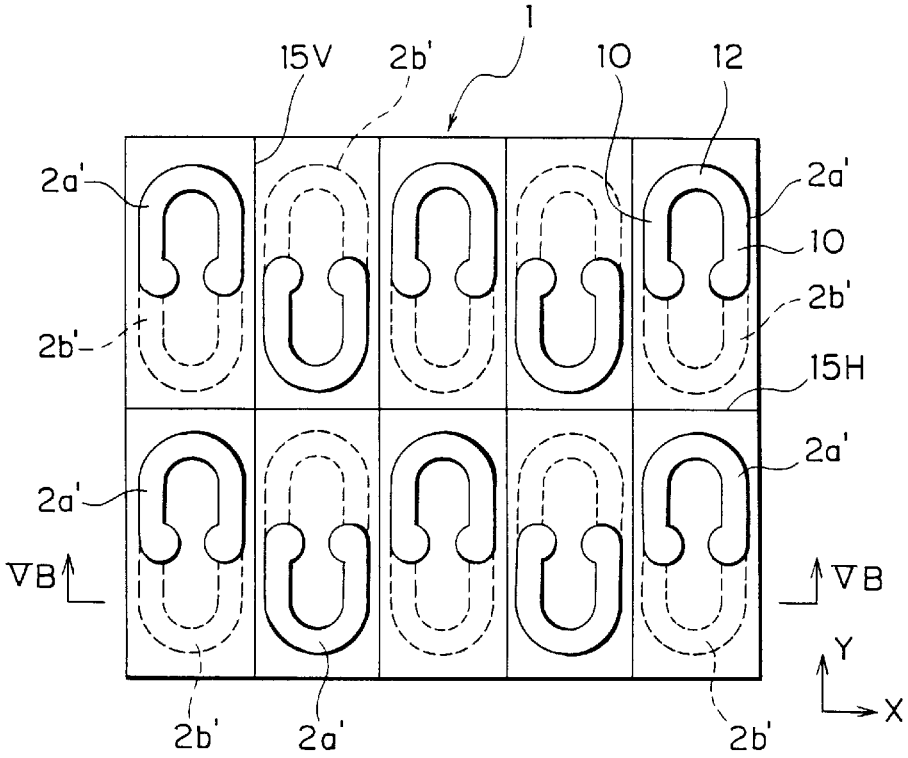
FIG. 5A is a plane view of an arrangement of coil pattern units after stacking the green sheets shown in FIG. 4A and FIG. 4B.
Figure 5B:
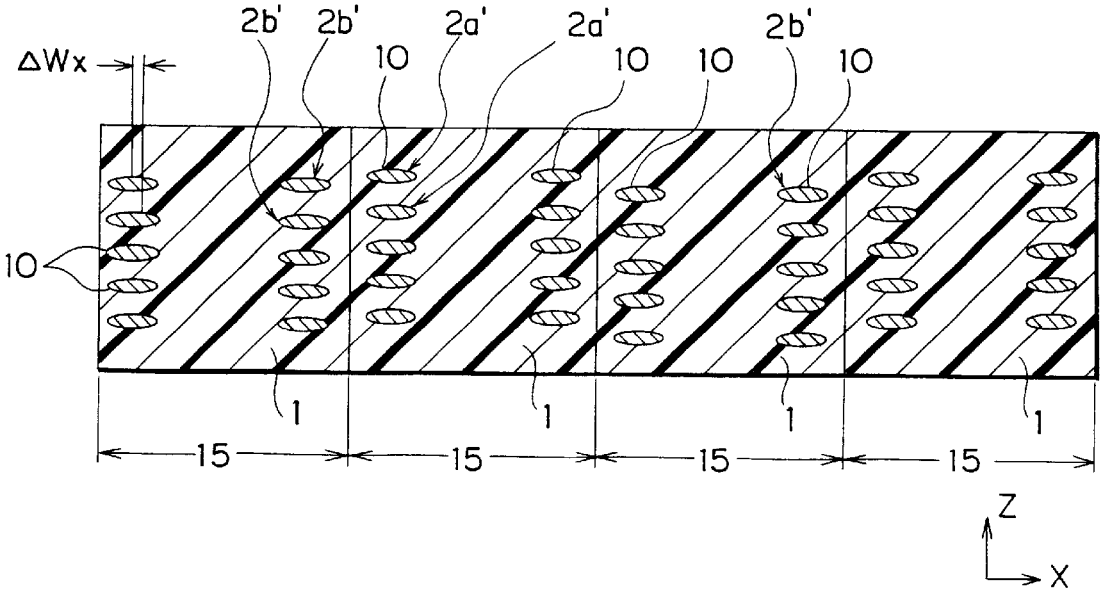
FIG. 5B is a sectional view of key parts along the line VB—VB of FIG. 5A.

With the process of production of an inductor device according to this embodiment as well, each two coil pattern units 2*a*' and 2*a*' (or 2*b*' and 2*b*') adjoining each other in the direction X substantially perpendicular to the longitudinal direction Y of the unit sections 15 are arranged centro-symmetrically with respect to a center point 15C1 of a vertical boundary line 15V of adjoining unit sections 15. Therefore, as shown in FIG. 5A and FIG. 5B, due to the superposition, in the stacking direction Z, of the linear patterns 10 of the coil pattern units 2*a*' (2*b*') formed in the unit sections, even if shifting of the linear patterns 10 starts in the perpendicular direction X, the linear patterns 10 of coil pattern units 2*b*' (2*a*') positioned under adjoining unit sections 15 will interfere with the shifting. As a result, in the present embodiment, it is possible to effectively prevent stack deviation in the direction X substantially perpendicular to the longitudinal direction Y of the unit sections 15 (longitudinal direction of the linear patterns 10).

Further, in the present invention, by arranging each two coil pattern units 2*a*' and 2*a*' ( 2*b*' and 2*b*') adjoining each other in the longitudinal direction Y of the unit sections 15, the repeating patterns of the coil pattern units 2*a*' (2*b*') become offset not only in the X-direction, but also the Y-direction (zigzag arrangement). As a result, a reduction of the Y-direction stack deviation ΔWy can also be expected.

Third Embodiment

Figure 6:
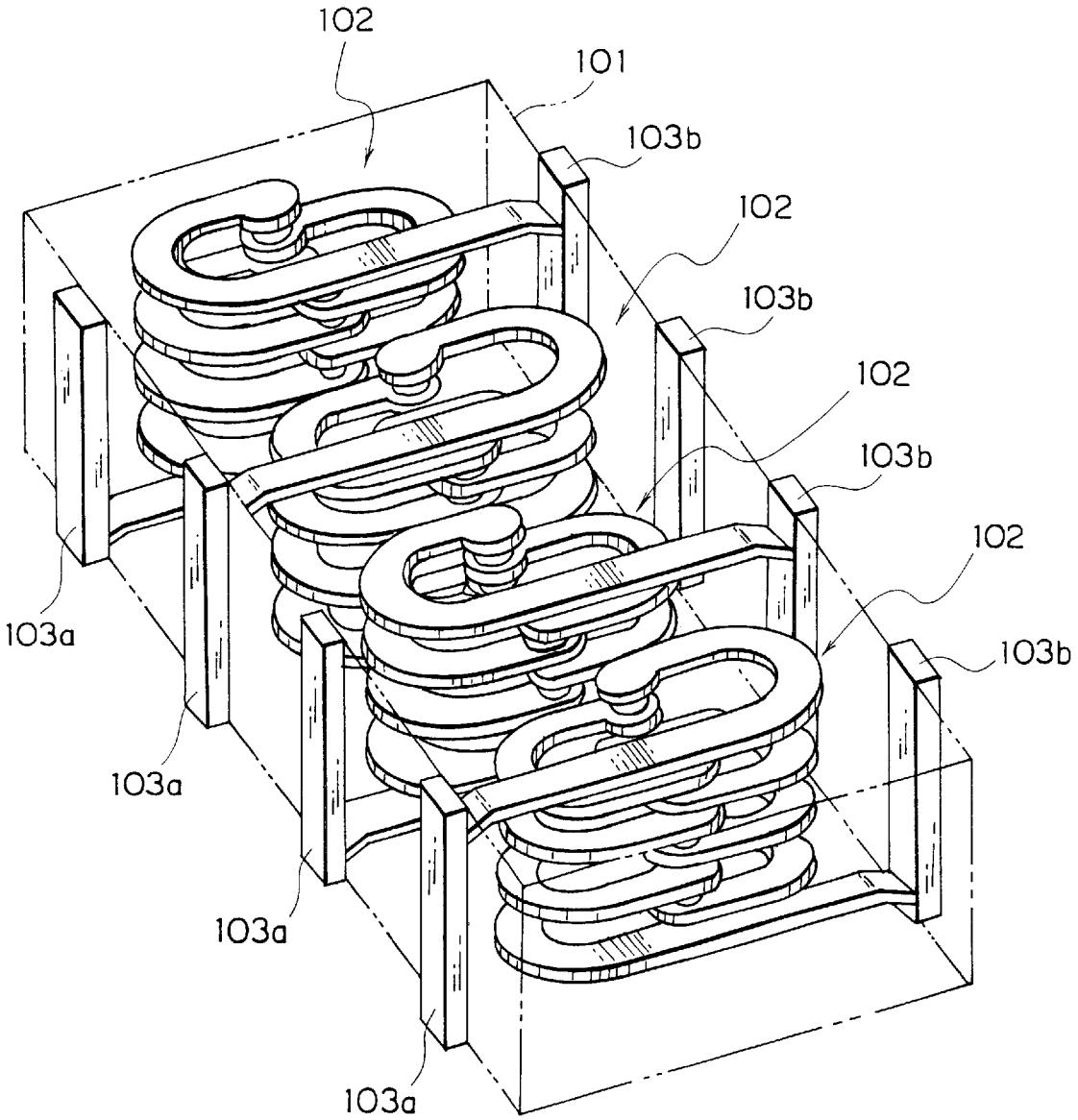
FIG. 6 is a see-through perspective view of key parts of an inductor device according to another embodiment of the present invention.
Figure 7A:
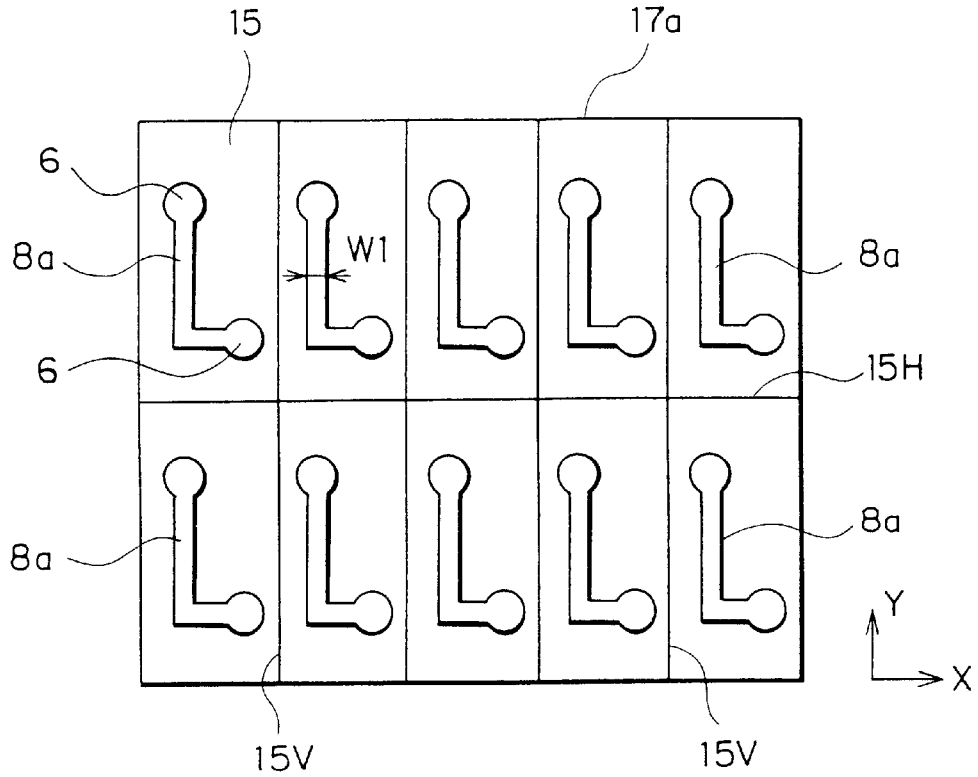
FIG. 7A and FIG. 7B are plane views of arrangements of coil pattern units formed on the surface of green sheets used in Comparative Example 1 of the present invention.
Figure 7B:
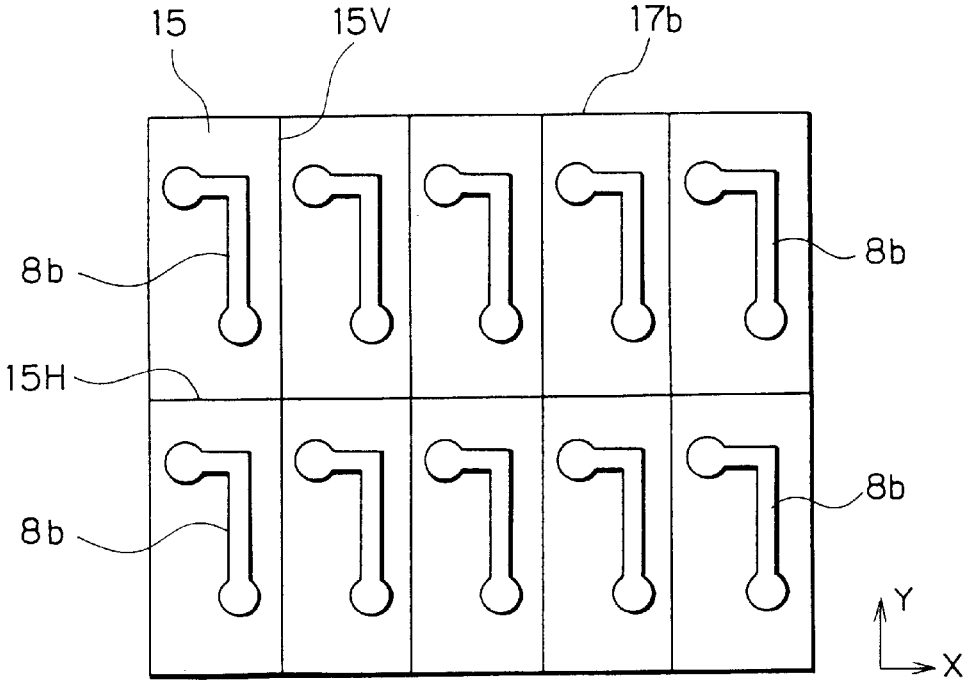
Figure 8A:
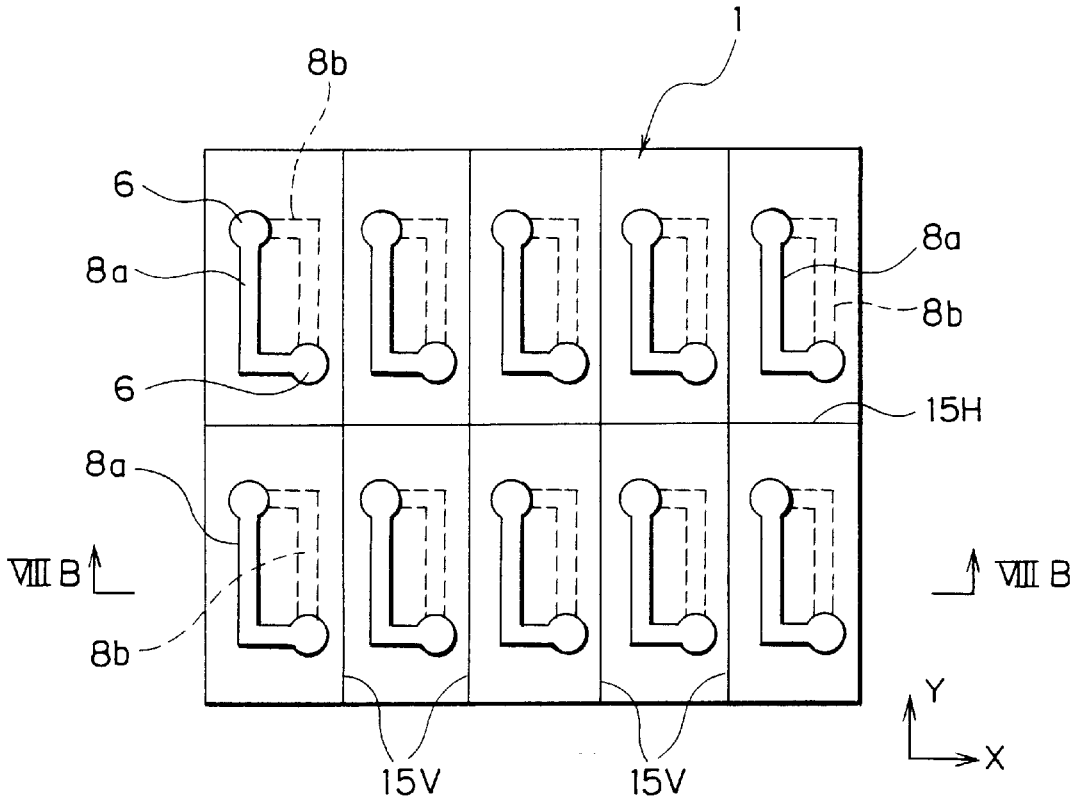
FIG. 8A is a plane view of an arrangement of coil pattern units after stacking the green sheets shown in FIG. 7A and FIG. 7B.
Figure 8B:
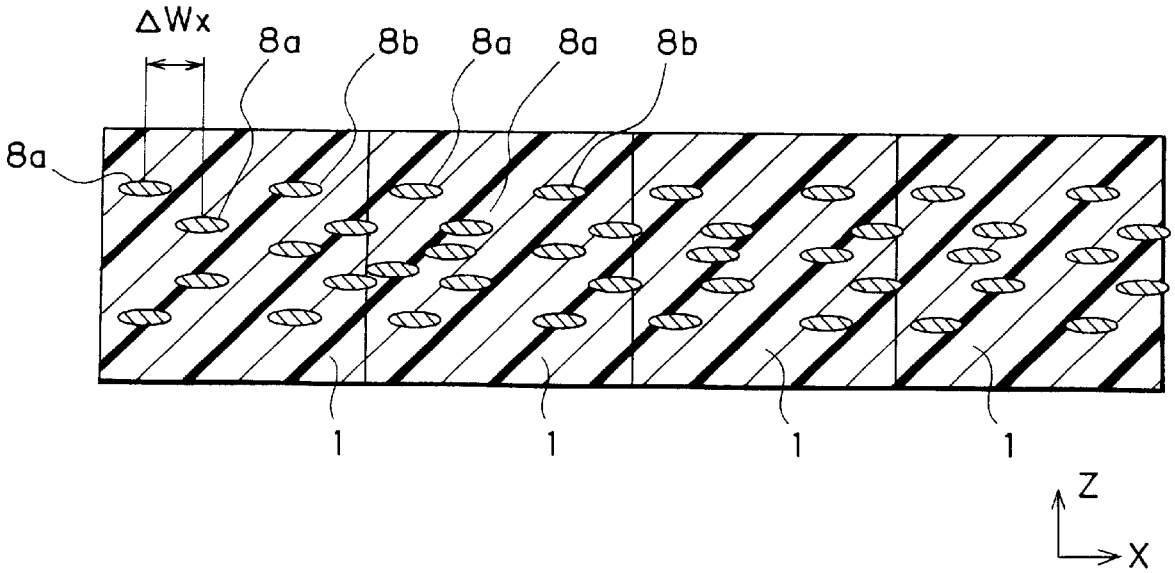
FIG. 8B is a sectional view of key parts along the line VIIIB—VIIIB of FIG. 8A.
Figure 9A:
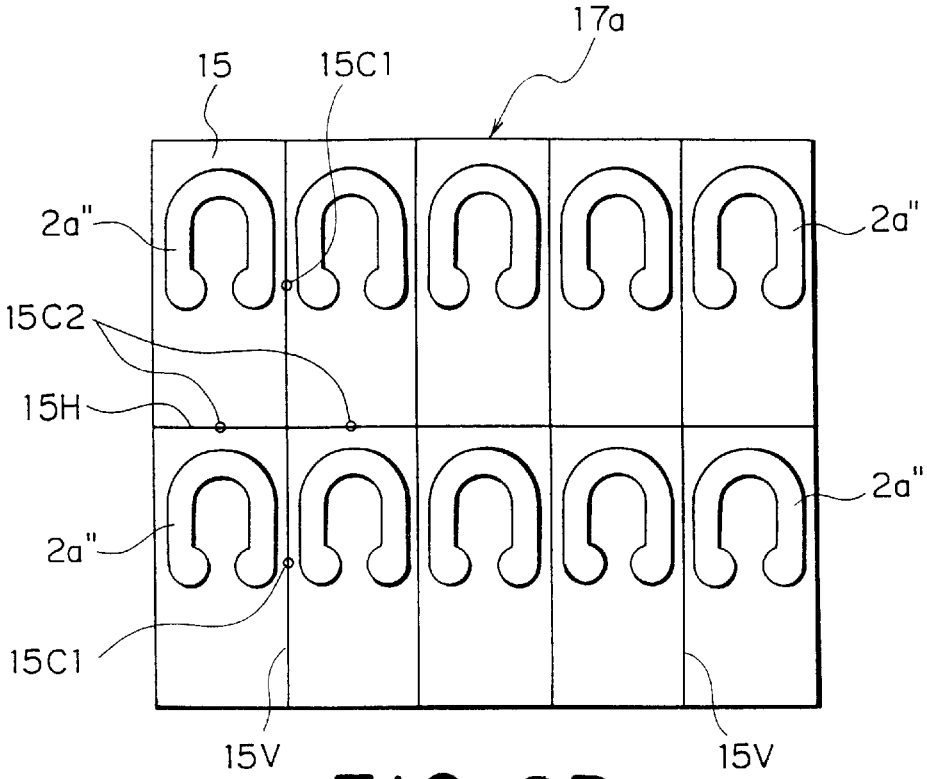
FIG. 9A and FIG. 9B are plane views of arrangements of coil pattern units formed on the surface of green sheets used in Comparative Example 2 of the present invention.
Figure 9B:
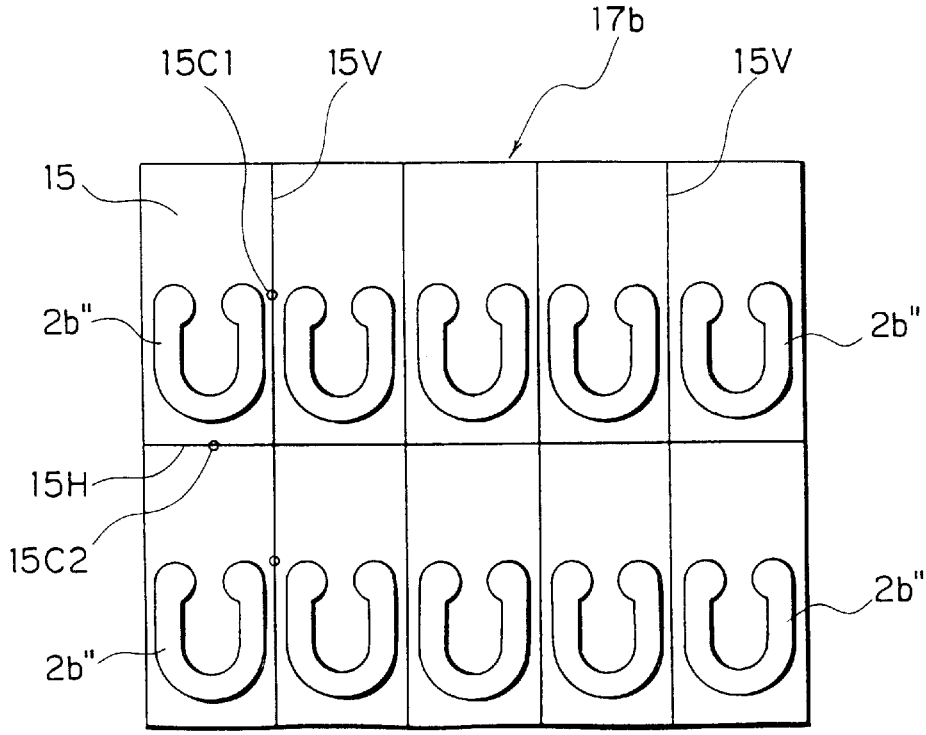

In the inductor array device according to the third embodiment (type of inductor device), as shown in FIG. 6, a plurality of coils 102 are arranged inside a single device body 101 along the longitudinal direction of the device body 101. A plurality of terminations 103*a* and 103*b* are formed at the side ends of the device body 101 corresponding to the coils 102.

The inductor array device of the embodiment shown in FIG. 6 differs from the inductor device shown in FIG. 1 in the point of the formation of a plurality of coils 102 inside the device body 101, but the coils 102 are configured the same as the coil shown in FIG. 1 and exhibit similar operations and advantageous effects.

The process of production of the inductor array device shown in FIG. 6 is almost exactly the same as the process of production of the inductor device shown in FIG. 1 and differs only in the point that when cutting the green sheets 17*a* and 17*b* shown in FIG. 2A and FIG. 2B after stacking, they are cut so that a plurality of pattern units 2*a* and 2*b* remain in the chips after cutting.

Note that the present invention is not limited to the above embodiments and may be modified in various ways without departing from the scope of the present invention.

For example, the specific shape of the coil pattern units formed in the unit sections is not limited to the illustrated embodiments and can be modified in various ways.

Next, the present invention will be explained with reference to examples and comparative examples, but the present invention is not limited to these in any way.

EXAMPLE 1

First, the green sheets for forming the insulating layers 7 of the device body 1 shown in FIG. 1 were prepared. The green sheets were fabricated as follows: A ferrite powder comprised of $(NiCuZn)Fe_2O_4$, an organic solvent comprised of toluene, and a binder comprised of polyvinyl butyral were mixed at a predetermined ratio to obtain a slurry. The slurry was coated on a PET film using the doctor blade method and dried to obtain a plurality of green sheets of a thickness tl of 15 μm.

Next, the green sheets were laser processed to form a predetermined pattern of through holes of diameters of b 80μm. Next, the green sheets were coated with silver paste by screen printing and dried to form coil pattern units 2*a* and 2*b* in predetermined centro-symmetric repeating patterns as shown in FIG. 2A and FIG. 2B.

The coil pattern units 2*a* and 2*b* had thicknesses t2 after drying of 10 μm. As shown in FIG. 2A, each consisted of two substantially parallel linear patterns 10, a curved pattern 12, and connection portions 6. The outer diameter D of the connection portions 6 was 120 μm, while the radius r of the outer circumference of the curved pattern 12 was 150 μm. The curved pattern 12 was shaped as a complete ½ arc. Further, the width W1 of the linear patterns 10 was 90 μm. The width of the curved pattern 12 was substantially the same as the width W1 of the linear patterns 10. The lateral width W0 of the unit sections 15, that is, the range in which a single coil pattern unit 2*a* or 2*b* was printed, was 0.52 mm and the longitudinal length L0 was 1.1 mm. The ratio of the thickness t2 of the coil pattern units with respect to the thickness t1 of the green sheets was ⅔.

Ten of the green sheets printed with the coil pattern units 2*a* and 2*b* in this way were alternately stacked and press-bonded at 50° C. and a pressure of 800 kg/cm$^2$, then the stack was cut using a knife and the section was observed to evaluate the maximum value of the X-direction stack deviation ΔWx.

Table 1 shows the results. The maximum value of the stack deviation ΔWx in the case of t2/t1 of ⅔ was confirmed to be a small one of 20 μm. Next, the same conditions were used, except for different t2 and t1, to form other stacks of green sheets and find their stack deviation ΔWx. The results are also shown in Table 1. It was confirmed that when t2/t1 becomes larger than ⅔, the stack deviation ΔWx becomes larger.

TABLE 1

| | | | | | | | | | |
|---|---|---|---|---|---|---|---|---|---|
| Coil pattern thickness t2 after printing and drying (μm) | 10 | 8 | 5 | 3 | 15 | 15 | 20 | 20 | 3 |
| Green sheet thickness t1 (μm) | 15 | 15 | 15 | 15 | 15 | 30 | 40 | 60 | 5 |
| t2/t1 | 2/3 | 8/15 | 1/3 | 1/5 | 1/1 | 1/2 | 1/2 | 1/3 | 3/5 |
| Stack deviation (μm) ΔWx | | | | | | | | | |
| Comp. Ex. 1 | 300 | 300 | 300 | 30 | 500 | 150 | 40 | 30 | 600 |
| Comp. Ex. 2 | 60 | 60 | 60 | 20 | 100 | 150 | 20 | 15 | 700 |
| Ex. 1 | 20 | 15 | 15 | 15 | 100 | 15 | 15 | 15 | 20 |
| Ex. 2 | 15 | 15 | 15 | 15 | 80 | 15 | 15 | 15 | 20 |

EXAMPLE 2

The same procedure was followed as in Example 1 to press-bond the green sheets and obtain a stack except that instead of using the coil pattern units 2*a* and 2*b* arranged in the repeating patterns shown in FIG. 2A and FIG. 2B, use was made of coil pattern units 2*a*' and 2*b*' arranged in the repeating patterns shown in FIG. 4A and FIG. 4B.

The stack was cut using a knife and the section was observed to evaluate the maximum value of the X-direction stack deviation ΔWx.

Table 1 shows the results. The maximum value of the stack deviation ΔWx in the case of t2/t1 of ⅔ was 15 μm. Next, the same conditions were used as with Example 1, except for different t2 and t1, to form other stacks of green sheets and find their stack deviation ΔWx. The results are also shown in Table 1. The stack deviation ΔWx was equal to or lower than that of Example 1.

Comparative Example 1

The same procedure was followed as in Example 1 to press-bond the green sheets and obtain a stack except that instead of using the coil pattern units 2*a* and 2*b* of the shape shown in FIG. 2A, use was made of coil pattern units 8*a* and 8*b* of the shapes shown in FIG. 7A, FIG. 7B, FIG. 8A, and FIG. 8B.

The coil pattern units 8*a* and 8*b* were substantially L-shaped as a whole comprised of a Y-direction long side linear pattern of a line width W1 of 80 μm and an X-direction short side linear pattern of the same width. The length of the long side linear pattern was 0.55 mm and the length of the short side linear pattern was 0.23 mm. The vertically stacked coil pattern units 8*a* and 8*b* were connected at the connection portions 6 through the through holes to form a coil.

The stack was cut using a knife and the section was observed to evaluate the maximum value of the X-direction stack deviation ΔWx.

Table 1 shows the results. The maximum value of the stack deviation ΔWx in the case of t2/t1 of ⅔ was 300 μm. Next, the same conditions were used as with Example 1, except for different t2 and t1, to form other stacks of green sheets and find their stack deviation ΔWx. The results are also shown in Table 1. When the thickness t1 of the green sheets was less than 30 μm, the stack deviation was not so large, but when it became smaller than 30 μm and t2/t1 became larger than ⅓, it was confirmed in Comparative Example 1 that the stack deviation became larger.

Comparative Example 2

The same procedure was followed as in Example 1 to press-bond the green sheets and obtain a stack except that instead of using the coil pattern units 2*a* and 2*b* of the shape shown in FIG. 2A, use was made of coil pattern units 2*a*" and 2*b*" of the shapes shown in FIG. 9A, FIG. 9B, FIG. 10A, and FIG. 10B.

The patterns of the coil pattern units 2*a*" and 2*b*" themselves were the same as the coil pattern units 2*a* and 2*b* in Example 1, but the arrangements of the repeating patterns differed. That is, the coil pattern units 2*a*" and 2*b*" were arranged at completely the same positions inside the unit sections and were neither centro-symmetric with respect to the center 15C1 of the vertical boundary line 15V of the unit sections 15 nor centro-symmetric with respect to the center 15C2 of the horizontal boundary line H.

The stack was cut using a knife and the section was observed to evaluate the maximum value of the X-direction stack deviation ΔWx.

Table 1 shows the results. The maximum value of the stack deviation ΔWx in the case of t2/t1 of ⅔ was 60 μm. Next, the same conditions were used as with Comparative Example 1, except for different t2 and t1, to form other stacks of green sheets and find their stack deviation ΔWx. The results are also shown in Table 1. When the thickness t1 of the green sheets was larger than 30 μm, the stack deviation was not so large, but when it became smaller than 30 μm and t2/t1 became larger than ⅓, it was confirmed in Comparative Example 2 that the stack deviation became larger.

Evaluation

As will be understood from a comparison of Examples 1 and 2 and Comparative Example 1 and Comparative Example 2 as shown in Table 1, it could be confirmed that the stack deviation ΔWx could be reduced compared with Comparative Examples 1 and 2 by using the processes of production of Example 1 and Example 2 when the green sheet thickness t1 was 3 to 25 μm and t2/t1 was ⅓ to ⅔.

What is claimed is:

1. A process for the production of an inductor device comprising the steps of;

forming a green sheet to form an insulating layer;

forming a plurality of conductive coil pattern units on the surface of the green sheet so that a plurality of unit sections each including a single coil pattern unit are arranged on the surface of the green sheet and each two coil pattern units adjoining in the substantially perpendicular direction to the longitudinal direction of the unit sections are arranged centro-symmetrically with respect to a center point of a boundary line of adjoining unit sections;

stacking a plurality of green sheets formed with the plurality of coil pattern units arranged centro-symmetrically and connecting the upper and lower coil pattern units separated by the green sheets to form a coil shape; and sintering the stacked green sheets, wherein the coil pattern units are each comprised of line symmetric patterns about a center line dividing a unit section across its width direction.

2. A process for the production of an inductor device, comprising the steps of:

forming a green sheet to form an insulating layer;

forming a plurality of conductive coil pattern units on the surface of the green sheet, each coil pattern unit comprising line symmetric patterns about a center line dividing a unit section across a width direction of the coil pattern unit, so that a plurality of unit sections each including a single coil pattern unit are arranged on the surface of the green sheet and each two coil pattern units adjoining in a substantially perpendicular direction to a longitudinal direction of the unit sections are arranged centro-symmetrically with respect to a center point of a boundary line of adjoining unit sections;

stacking a plurality of green sheets formed with the plurality of coil pattern units arranged centro-symmetrically so that the coil pattern units are alternately stacked and connecting the upper and lower coil pattern units separated by the green sheets to form a coil shape; and sintering the stacked green sheets.

3. The process for the production of an inductor device as set forth in claim 2, wherein, when forming the plurality of coil pattern units on the surface of the green sheet, each two coil pattern units adjoining in the longitudinal direction of the unit sections are arranged at the same positions inside the individual unit sections.

4. The process for the production of an inductor device as set forth in claim 2, wherein the coil pattern units are each comprised of two substantially parallel linear patterns and a curved pattern connecting first ends of the linear patterns.

5. The process for the production of an inductor device as set forth in claim 2, wherein the plurality of green sheets are stacked so that each two coil pattern units adjoining each other in the stacking direction through a green sheet become line symmetrical with respect to a center line dividing the unit sections across the longitudinal direction.

6. The process for the production of an inductor device as set forth in claim 2, wherein coil pattern units of a thickness of ⅓ to ⅔ of the thickness of green sheets are formed on the surface of green sheets of a thickness of 3 to 25 $\mu$m.

7. The process for the production of an inductor device as set forth in claim 2, wherein, further comprising, before the sintering step, a step of cutting the stacked green sheets for each unit section.

8. The process for the production of an inductor device as set forth in claim 2, wherein, further comprising, before the sintering step, a step of cutting the stacked green sheets for each plurality of unit sections.

* * * * *